US008103180B2

(12) United States Patent
Yuasa

(10) Patent No.: US 8,103,180 B2
(45) Date of Patent: Jan. 24, 2012

(54) IMAGE FORMING DEVICE AND IMAGE FORMING METHOD THEREOF

(75) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 203 days.

(21) Appl. No.: 12/426,400

(22) Filed: Apr. 20, 2009

(65) Prior Publication Data

US 2009/0269091 A1 Oct. 29, 2009

(30) Foreign Application Priority Data

Apr. 24, 2008 (JP) ..... 2008-113370

(51) Int. Cl.
*G03G 15/00* (2006.01)

(52) U.S. Cl. ..... 399/45

(58) Field of Classification Search ..... 399/45, 399/197, 196, 389
See application file for complete search history.

(56) References Cited

U.S. PATENT DOCUMENTS 5,285,247 A * 2/1994 Itoh ..... 358/300
6,813,451 B2 * 11/2004 Wibbels ..... 399/45
7,062,217 B2 * 6/2006 Tsukamoto et al. ..... 399/401

FOREIGN PATENT DOCUMENTS

JP A-2002-338084 11/2002
JP A-2004-129069 4/2004
JP 2005-193615 A 7/2005
JP A-2006-171556 6/2006

OTHER PUBLICATIONS

JP 2006-171556 A, machine translation downloaded Jan. 5, 2011.*

* cited by examiner

*Primary Examiner* — Constantine Hannaher
(74) *Attorney, Agent, or Firm* — Posz Law Group, PLC

(57) ABSTRACT

An image forming device includes a first measuring unit to measure a size of the recording medium when the image is formed on the first surface by the image forming unit, and a second measuring unit to measure the size of the recording medium prior to an image being formed on the second surface of the recording medium, and a control unit configured to change the size of printing range based upon the image data that is used to form the image on the second surface of the recording medium in accordance with a medium ratio of the size of the recording medium measured by the first measuring unit to the size of the recording medium measured by the second measuring unit.

21 Claims, 10 Drawing Sheets

IMAGE FORMING DEVICE AND IMAGE FORMING METHOD THEREOF

CROSS REFERENCE TO RELATED APPLICATION

The present application is related to, claims priority from and incorporates by reference Japanese Patent Application No. 2008-113370, filed on Apr. 24, 2008.

TECHNICAL FIELD

The present invention relates to an image forming device for forming images on both sides of a recording medium.

BACKGROUND

In association with need diversification, such as conserving resources with electrographic image printers, demand for printing on both sides (double-sided printing) of a recording medium is becoming greater. In addition, maintaining print quality at the time of double-sided printing is also important, as are preventing misalignment of printed positions on both sides and preventing a difference in print size. However, in a medium heated by a heat fixer, moisture contained in the recording medium evaporates due to the heat, and as a result the recording medium shrinks after the fixing of front surface printing. Then, when printing is performed on a rear surface, it causes the printed position to shift and a difference in image size on the two sides.

Further, in many cases, a carrying direction is reversed and the recording medium is inverted by an inversion mechanism for double-sided printing. Therefore, a back end side at the time of printing the front surface will be a front end side at the time of printing the rear surface. Consequently, when the size of the medium is not uniform, a printing start position on the rear surface to be printed next may not be matched with the back end of the front surface printed first, and as a result, print margins are to be shifted on the two sides.

Japanese laid-open application publication number 2005-193615 discloses technology to make positional differences of the same image difficult to be realized in the case of printing both sides of the recording medium. According to the above Japanese laid-open publication, a medium supply detecting unit is arranged in the vicinity of an inlet of an image forming unit in an image forming device, the recording medium length is detected, and shrinkage of the recording medium before and after a fixing process of a recording medium to be carried first is calculated. Then, writing start timing to a recording medium to be carried next is corrected based upon the calculated shrinkage.

However, in the above cited patent reference, because the calculation result of the shrinkage is applied to the recording medium to be carried next, the writing start timing of the recording medium to be carried first is not always corrected.

SUMMARY

The present invention is for maintaining a correct image position and image size in printing of a second surface of a recording medium in double-sided printing. In other words, a shrinkage factor of a recording medium to be carried first is detected, and the timing to start writing and the size of image data on the second surface are corrected based on the detected shrinkage factor.

In order to solve the aforementioned problems, the invention is an image forming device includes a medium carrying path configured to carry a recording medium, an image forming unit configured to form an image, based on image data, onto the recording medium carried on the medium carrying path, a fixing unit configured to fix the image formed by the image forming unit onto the recording medium, a medium inversion path configured to invert the recording medium where the image has been fixed onto the first surface by the fixing unit to the second surface, and to carry the recording medium to the image forming unit, a first measuring unit placed within the medium carrying path and configured to measure a size of the recording medium when the image is formed on the first surface by the image forming unit, a second measuring unit configured to measure the size of the recording medium prior to another image being formed on the second surface of the recording medium by the image forming unit, and a control unit configured to change the size of the printing range based upon the image data that is used to form the image on the second surface of the recording medium in accordance with a ratio of the size of the recording medium measured by the first measuring unit to the size of the recording medium measured by the second measuring unit.

The present invention is, for double-sided printing, to change image size and an image position at printing of the second surface of a first recording medium. In other words, an image forming device that enables double-sided printing without printed position shift on two sides and prevents any difference in image size from the first recording medium to be carried can be provided.

DETAILED DESCRIPTION

First Embodiment

Figure 1:
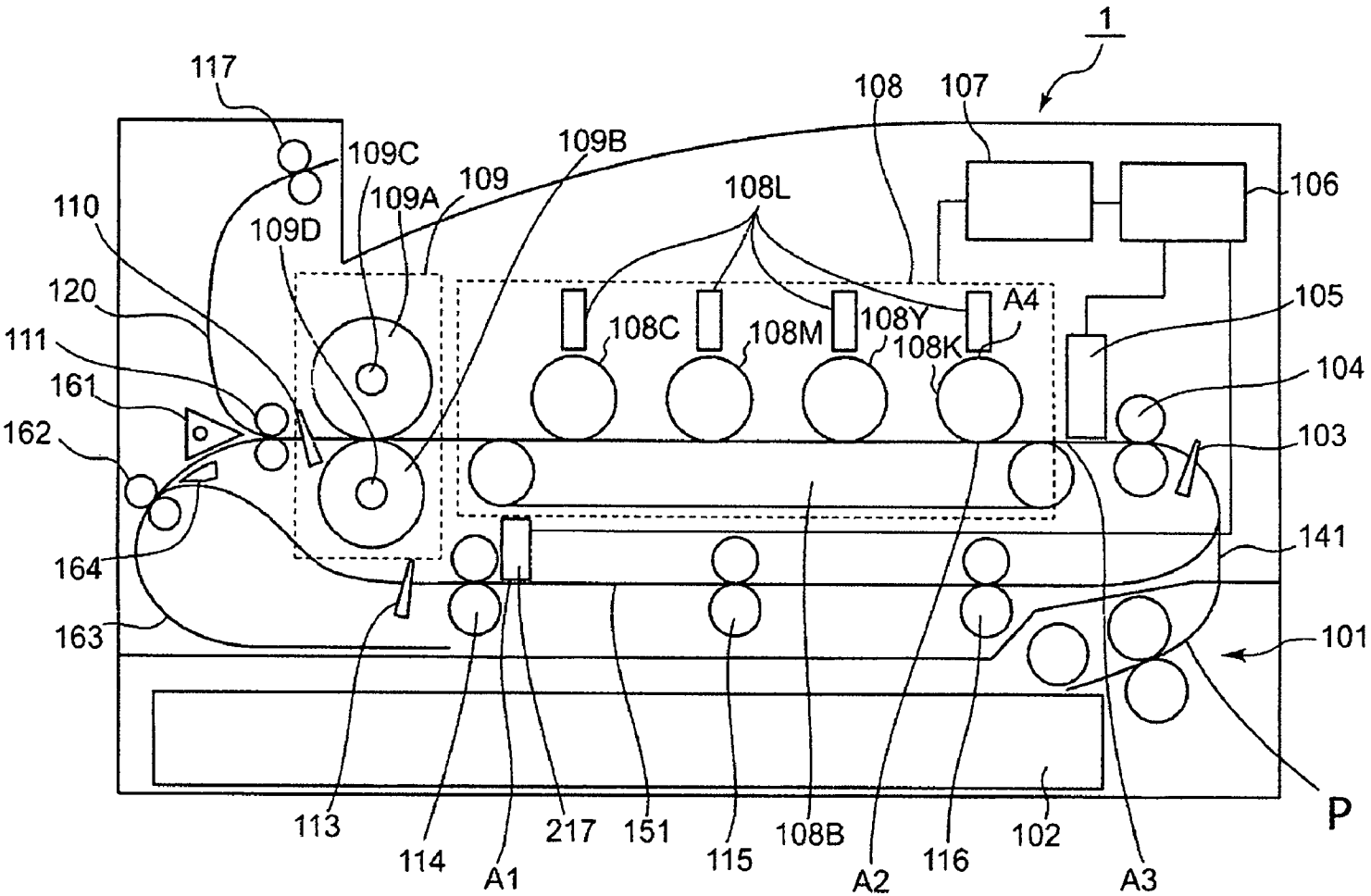
FIG. 1 is a schematic configuration diagram illustrating an image formatting device relating to a first embodiment.

FIG. 1 is a schematic configuration view illustrating an image forming device 1 relating to a first embodiment of the present invention. A paper feeding unit 101 is driven by a not-illustrated drive system, and feeds a recording medium P mounted on a paper feeding cassette 102 to a medium path 141 toward a registration roller 104. A paper feeding detecting means 103 detects that the recording medium P is fed to the registration roller 104. A medium length measuring unit 105 detects front and back ends of the recording medium P carried on the medium path 141 at constant speed with a high degree of accuracy, for example, using a reflective optical sensor.

The medium length measuring unit 105 is placed in the vicinity of a roller-pair nip part comprising the registration roller 104, and detects the front and back ends of the recording medium P passing the registration roller 104. When the medium length measuring unit 105 is turned on by an optical path of the optical sensor being blocked with the front end of the recording medium P to be carried on the medium path 141, a not-illustrated control means starts to count a drive pulse of a not-illustrated motor to rotate a not-illustrated belt drive roller of the medium path 141. In the meantime, when the medium length measuring unit 105 is turned off by the optical path of the optical sensor being released with the back end of the recording medium P, the control means finishes counting the drive pulse of the motor.

Herewith, the medium length measuring unit 105 is designed to send information about the count start and count end for the drive pulses to a recording medium length calculating comparing unit (RMLCC unit) 106 to be described later, as a detection result. The RMLCC unit 106 is configured to calculate the length of the recording medium P from a sum of the pulse number of the drive pulses. In addition, the medium length measuring unit 105 is connected to the RMLCC unit 106, and the RMLCC unit 106 is connected to an image data control unit 107.

An image forming unit 108 is composed of photoreceptor drums 108K, 108Y, 108M and 108C (or one embodiment of a photoreceptor body) for forming an image; an LED head 108L arranged to face the photoreceptor drums 108K, 108Y, 108M and 108C as exposure devices to expose the photoreceptor drums 108K, 108Y, 108M and 108C using a light-emitting diode as a light source; a transferring belt unit 108B, and so on. The image forming unit 108 is controlled by the image data control unit 107, and forms an image on the recording medium P according to a predetermined image formation process. The image forming unit 108 forms an image on one side of the recording medium P by synchronizing with registration roller 104, and then by carrying the recording medium P to a downstream image fixing means 109.

The image fixing means 109 is composed of a roller pair 109A and 109B pressured by predetermined contact pressure, and the roller pair incorporates heaters 109C and 109D for heating, respectively. A carriage detecting unit 110 detects a passage of the recording medium P where an image has been fixed by the image fixing means 109. A carrier roller pair 111 is placed ahead of the carriage detecting unit 110, and a separator 161 to separate the carrying direction of the recording medium P to a medium ejection path 120 or a medium inversion path 151 is arranged at the downstream side of the carrier roller pair 111. The separator 161 is switched and driven to one of the two directions at the time of ejection/inversion of the recording medium P, based on the control of a not-illustrated control unit.

The medium ejection path 120 is a path to eject the recording medium P where an image has been fixed by an ejection roller pair 117. In the meantime, the medium inversion path 151, in the case of double-sided printing, is a path to invert the recording medium P from a first surface to a second surface by the medium inversion roller pair 162 and an evacuation path 163, and in addition, to re-guide the recording medium P to the image forming unit 108 by paper re-feeding carrier roller pairs 114, 115 and 116.

The medium inversion roller pair 162 is a positively- and negatively-rotatable recording medium inversion means driven based on the control of not-illustrated control unit. The medium inversion roller pair 162 temporarily carries the recording medium P to be carried from the separator 161 to the evacuation path 163. An inversion guide 164 is placed between the separator 161 and the medium inversion roller pair 162. After the medium inversion roller pair 162 guides the recording medium P to the evacuation path 163 for evacuation and the back end of the recording medium P passes the inversion guide 164, the medium inversion roller pair 162 is inversely rotated due to the control of the control unit. Then, the back end of the recording medium P becomes a front end and the recording medium P doubles back at the inversion guide 164, and the recording medium P is carried to the medium inversion path 151. Thus, for the recording medium P, the carrying direction is inverted back to front; concurrently, the two sides are inverted.

A carrier detecting means 113 placed on a medium inversion path 151 detects the recording medium P carried on the medium inversion path 151 in order to re-carry the recording medium P whose two sides are inverted to the image forming unit 108. In addition, the paper re-feeding carrier roller pairs 114, 115 and 116 are driven and controlled by not-illustrated drive system and control unit, and carry the recording medium P to the registration roller 104 for re-feeding.

A second medium length measuring unit (SMLM unit) 217 is placed in the vicinity of the paper re-feeding carrier roller pair 114 within the medium inversion path 151. The SMLM unit 217 is arranged in the vicinity of the nip part of the paper re-feeding carrier roller pair 114 in order to enhance the detection accuracy of the recording medium P, and detects the front and back ends of the recording medium P to be carried similarly to the medium length measuring unit 105.

When the SMLM unit 217 is turned on by blocking the optical path of the optical sensor with the front end of the recording medium P to be carried on the medium inversion path 151, a not-illustrated control means starts counting a drive pulse of a not-illustrated motor to rotate a not-illustrated belt drive roller in the medium inversion path 151. In the meantime, when the SMLM unit 217 is turned off by releasing the optical path of the optical sensor with the back end of the recording medium P, the control means finishes counting the drive pulse of the motor.

Herewith, the SMLM unit 217 is designed to send information about the count start and count end for the drive pulses to the RMLCC unit 106 to be described later, as a detection result. The RMLCC 106 is configured to calculate the length of the recording medium P from a sum of the pulse number of drive pulses.

Herein, the relationship between the position to place the SMLM unit 217 and the maximum size of a two-sided printable recording medium P in the image forming device 1 is explained. A point A1 shown in FIG. 1 is a measurement point of the SMLM unit 217, and a point A2 is a transfer position to the transferring belt unit 108B in the most upstream photoreceptor drum 108K of the image forming unit 108. Further, in the case of printing without any margin from the front end of the recording medium, a point A3 is a position where the front end of the being-carried recording medium P exists when exposure is started from the most upstream LED head 108L to the photoreceptor drum 108K, i.e., a position of the front end at the time of exposure start. Furthermore, a point A4 is a position of exposure start to start the exposure from the most upstream LED head 108L to the photoreceptor drum 108K.

The first distance from the point A1 as the measurement position of the SMLM unit 217 to the point A2 as the transfer position should be greater than length of the maximum size of the recording medium P. This is because, as described later, after the length of the second surface of the recording medium P is measured, it is necessary to calculate a shrinkage factor α, to correct the image data of the second surface, and then to print the image. Therefore, preferably, the second distance from the point A1 as the measurement position of the SMLM unit 217, to the position A3 as the front end position at the time of exposure start, should be greater than the medium length of the maximum size of recording medium P. For example, when it is possible for the image forming device 1 to double-sided-print A3 paper, the second distance from the point A1 as the measurement position to the point A3 as the front end position at the time of exposure start, should be longer than the 420 mm, which is the length of A3 paper in the lengthwise direction.

Furthermore, a difference between the first distance from the point A1 as the measurement position to the point A2 as the transfer position and the second distance from the point A1 as the measurement position to the point A3 as the front end position at the time of exposure start is equivalent to a distance on the circumference (or circumferential distance) of the photoreceptor drum 108K from the position A4 as the exposure start position to the point A2 as the transfer position.

Further, the SMLM unit 217 is connected to the RMLCC unit 106 similarly to the medium length measuring unit 105.

After the recording medium P is carried on the medium inversion path 151, an image is formed on the second surface, which is the opposite side where the image has already been formed, with the same process as that at the time of the image formation to the first surface of the recording medium P, which is re-fed to the registration roller 104. After the image fixing means 109 re-fixes the image, the separator 161 is switched to the eject side. The carrier roller pair 111 and the ejection roller pair 117 eject the recording medium P to the outside of the device via the medium ejection path 120.

Figure 2:
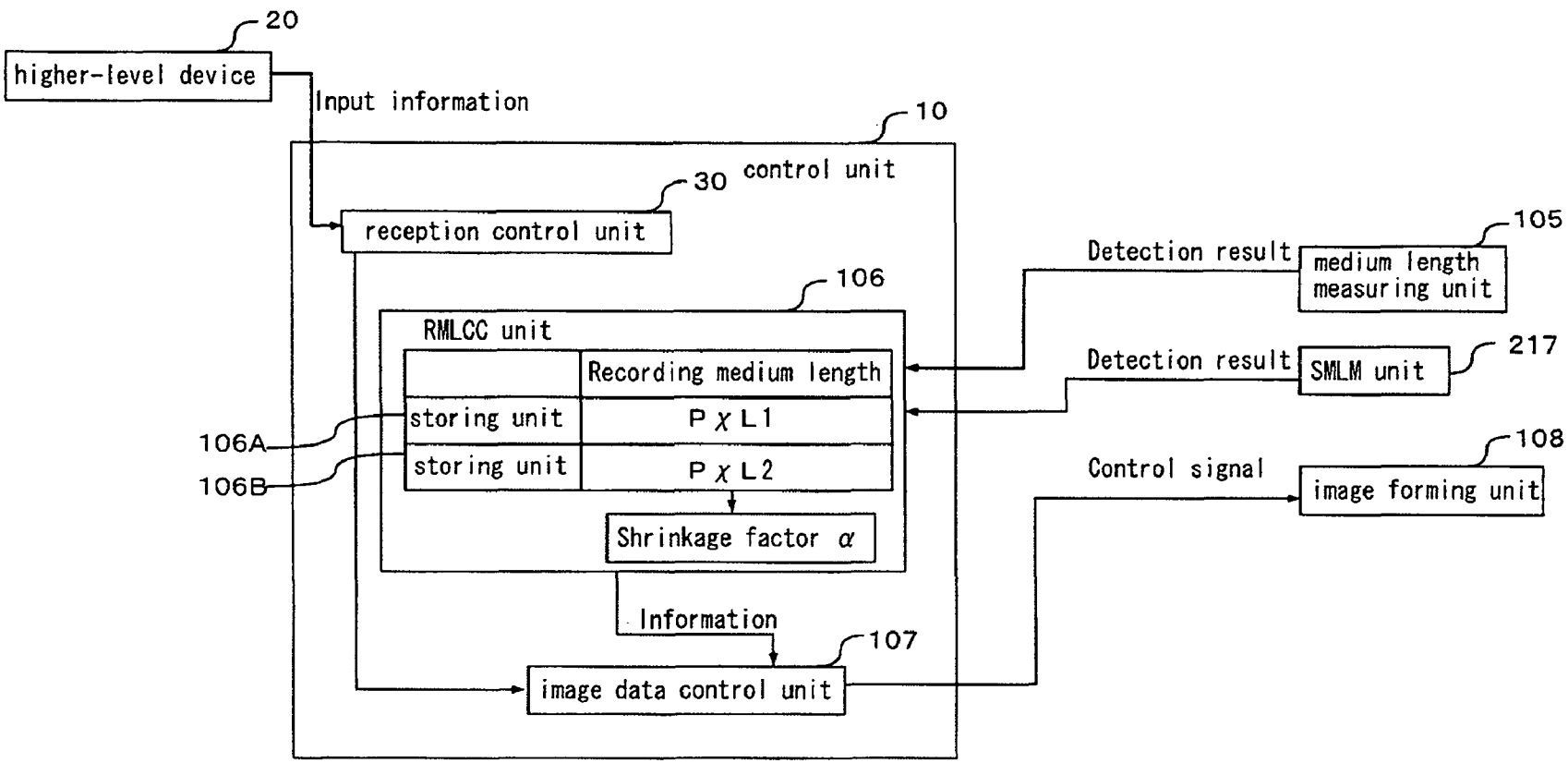
FIG. 2 is a block diagram illustrating a control unit of the image forming device relating to the first embodiment.

FIG. 2 is a block diagram illustrating the control unit 10 of the image forming device 1 regarding the first embodiment. The control unit 10 receives input information containing image data from a higher-level device 20 of the image forming device 1 by a reception control unit 30. The input information received by the reception control unit 30 is sent to the image data control unit 107, and the image data control unit 107 controls the image forming unit 108 and an image is formed.

In the meantime, the information as a detection result of the front and back ends of the first surface of the recording medium P detected by the medium length measuring unit 105 is sent to the RMLCC unit 106. In addition, the information as a detection result of the front and back ends of the second surface of the recording medium P detected by the SMLM unit 217 is also sent to the RMLCC unit 106. The RMLCC unit 106 has storing units 106A and 106B for at least two recording media, and the detection results from the medium length measuring unit 105 and the SMLM unit 217 can be separately stored, respectively.

In other words, the information about the front and back ends of the first surface of the recording medium P sent by the medium length measuring unit 105 is calculated as the length P×L1 of the recording medium P, and the value is stored in the storing unit 106A. The information about the front and back ends of the second surface of the recording medium P sent by the SMLM unit 217 is calculated as the length P×L2 of the recording medium P, and the result is stored in the storing unit 106B.

In addition, it is possible for the RMLCC unit 106 to compare the information P×L1 and P×L2 stored in the storing unit 106A and 106B, respectively. The comparison is calculated as the shrinkage factor: $\alpha = P \times L2 / P \times L1$, and the result is sent to the image data control unit 107.

The image data control unit 107 controls to form an image without any special process of image data from the higher-level device 20 at the time of normal image formation or the image formation on the first surface in the double-sided printing. Further, when the information about the shrinkage factor α, which is a comparison result of the length of the recording medium P, is sent by the RMLCC unit 106, the image data control unit 107 controls so as to change the size of an image based upon the comparison result. In other words, the image data control unit 107 controls the size of an image to be formed on the second surface of the recording medium P based upon the information about the shrinkage factor α, and the image forming unit 108 forms an image.

Next, performance of the image forming device 1 regarding the first embodiment is explained. In FIG. 1, a recording medium P1 to be carried among the recording media P mounted on the paper feeding cassette 102 is fed toward the image forming unit 108 by the paper feeing unit 101.

When the paper feeding detecting means 103 arranged at the downstream side of the paper feeding unit 101 detects paper feeding of the recording medium P1, the registration roller 104 carries the recording medium P1 to the image forming unit 108. The image forming unit 108 is synchronized with the registration roller 104, and forms an image based upon the image data controlled by the image data control unit 107 with the predetermined image formation process.

At this time, the medium length measuring unit 105 detects a front end of the recording medium P1 carried from the registration roller 104 toward the image forming unit 108, and when the back end of the recording medium P1 passes through the medium length measuring unit 105 in association with the carrying of the recording medium P1, the medium length measuring unit 105 detects the back end. Based upon the detection result, the RMLCC unit 106 calculates the length of the recording medium P1, and stores information about the length P1L1 of the recording medium P1 on the first surface in the storing unit 106A.

An image is transferred and formed on one side of the recording medium P1 to the image forming unit 108, and the recording medium P1 is carried to the downstream image fixing means 109. The image fixing means 109 fixes the image onto the recording medium P1 with heat and pressure of the roller pairs 109A and 109B heated by the heaters 109C and 109D, and the image formation to the first surface is completed.

At the time of double-sided printing for forming an image on the second surface of the recording medium P1 to be carried first, a carriage detecting unit 110 detects the passage of the recording medium P1 where the image has been fixed by the image fixing means 109 and the separator 161 guides the recording medium P1 to a medium inversion roller 162. The medium inversion roller pair 162 temporarily carries the recording medium P1 carried from the separator 161 to the evacuation path 163. After the back end of the recording medium P passes through the inversion guide 164, the medium inversion roller pair 162 is inversely rotated due to the control of the control unit. The back end of the recording medium P becomes a front end and doubles back through the inversion guide 164, and the recording medium P is carried to the medium inversion path 151. Thus, the carrying direction of the recording medium P is inverted; concurrently, the two sides are inverted. Then, the paper re-feeding carrier roller pairs 114, 115 and 116 are driven and controlled by not-illustrated drive system and control unit, and re-feed the recording medium P to the registration roller 104.

At this time, the SMLM unit 217 detects the front end of the recording medium P1 carried on the medium inversion path 151 toward the image forming unit 108, and then detects the back end when the back end of the recording medium P1 passes through the SMLM unit 217 in association with the carriage of the recording medium P1. The RMLCC unit 106 calculates the length of the recording medium P1 based upon the detection result, and stores the information about length P1L2 of the recording medium on the second surface in the storing unit 106B.

The image forming unit 108 forms an image on the second surface with the same process as that at the time of the printing the first surface, and the image fixing means 109 fixes the image onto the second surface of the recording medium P1. Then, the passage of the recording medium P is detected by the carriage detecting unit 110, and the recording medium P is ejected to the outside of the device by the carrier roller pair 111 and the ejection roller pair 117, and the image formation on both sides is completed.

Figure 3:
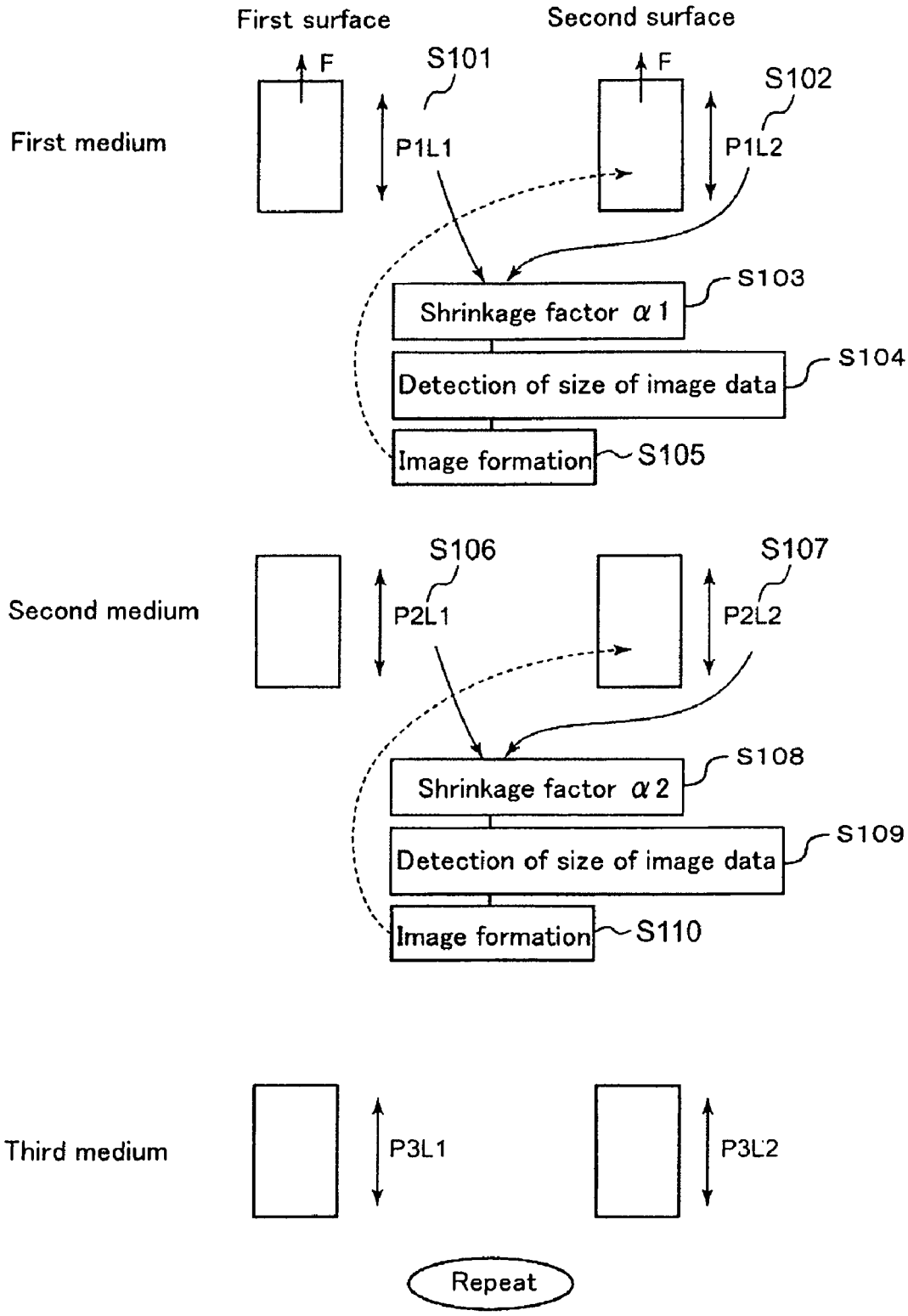
FIG. 3 is an explanatory diagram illustrating performance of the first embodiment.

FIG. 3 is an explanatory diagram illustrating performance of the first embodiment of the present invention. In printing of the first recording medium P, the medium length measuring unit 105 detects the length P1L1 of the first surface in the carrying direction (S101). Then, the recording medium P is carried to the image forming unit 108 and the first surface is printed, and the image fixing means 109 fixes an image. At this time, the recording medium P shrinks as described above. The recording medium P is sent to the medium inversion path 151, and the SMLM unit 217 detects the length P1L2 of the second surface (S102).

As described above, when the recording medium lengths P1L1 and P1L2 are stored in the storing units 106A and 106B of the RMLCC unit 106, the RMLCC unit 106 calculates a shrinkage factor $\alpha$1 (S103). The RMLCC unit 106 sends the calculated shrinkage factor $\alpha$1 to the image data control unit 107. The image data control unit 107 corrects the image data sent from the higher-level device 20 based upon the shrinkage factor $\alpha$1 and determines the size of the image data to be printed on the second surface (S104). When the image data control unit 107 sends the image data to the image forming unit 108, the image forming unit 108 forms an image on the second surface of the recording medium P based upon this image data (S105).

Similarly, in printing of the second recording medium P, the medium length measuring unit 105 detects the length of the first surface of the second medium P2L1 (S106). Then, the recording medium P is carried to the image forming unit 108 and the first surface is printed, and the image fixing means 109 fixes the image. The recording medium P is sent to the medium inversion path 151, and the SMLM unit 217 detects the length of the second surface of the second medium P2L2 (S107).

When the recording medium lengths P2L1 and P2L2 are stored in the storing units 106A and 106B of the RMLCC unit 106, the RMLCC unit 106 calculates a shrinkage factor $\alpha$2 (S108). The RMLCC unit 106 sends the calculated shrinkage factor $\alpha$2 to the image data control unit 107. The image data control unit 107 corrects the image data sent from the higher-level device 20 based upon the shrinkage factor $\alpha$2, and determines the size of the image data to be printed onto the second surface (S109). When the image data control unit 107 sends the image data to the image forming unit 108, the image forming unit 108 forms the image on the second surface of the recording medium P based upon this image forming unit 108 (S110). Hereafter, this process is repeated.

This enables the correction of the image data in printing of the second surface from the (first) recording medium P1 to be carried first. Further, the measurement of the recording medium length P2L2 at the time of printing the second surface of the (second) recording medium P2 and the calculation of the shrinkage factor $\alpha$ according to the comparison with the length P2L1 at the time of printing the first surface enable the maintenance of the information about the shrinkage factor $\alpha$ of the recording medium P always as latest.

Figure 4:
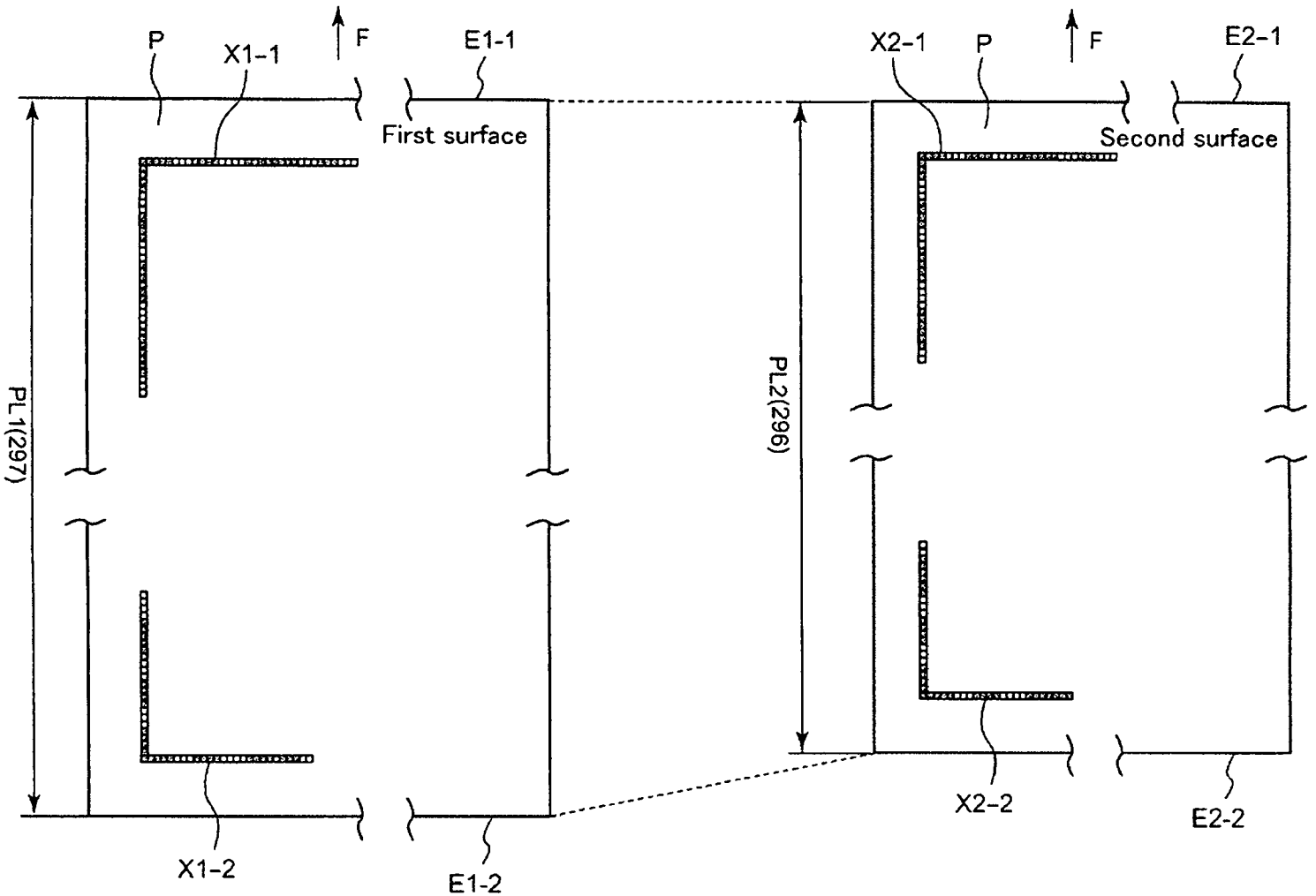
FIG. 4 is a schematic diagram illustrating a change in the size of the recording medium before and after forming an image on the first surface.

Next, a correction method for size of image data to be formed on the second surface is described with an illustrative example. FIG. 4 is a schematic view illustrating a change in size of the recording medium P before and after the image formation on the first surface. As a shrinkage example of the recording medium P, the recording medium P with A4 size is used, and it is assumed that the length PL1 in the carrying direction F at the time of the first surface image formation is detected as 297 mm, and the length PL2 in the carrying direction F at the time of the second surface image formation is detected as 296 mm (the recording medium P shrinks by 1 mm). The shrinkage factor ($\alpha$=PL2/PL1) of the recoding medium P at this time is 99.66%. Furthermore, in FIG. 4, E1-1 indicates a front end of the recording medium P at the time of printing the first surface, and E1-2 indicates a back end of the recording medium P. X1-1 indicates a printing start position on the first surface of the recording medium P, and X1-2 indicates a printing end position on the first surface of the recording medium P. In addition, E2-1 indicates a front end of the recording medium P at the time of printing the second surface, and E2-2 indicates a back end of the recording medium P. X2-1 indicates a printing start position on the second surface of the recording medium P, and X2-2 indicates a printing end position on the second surface of the recording medium P.

Figure 5:
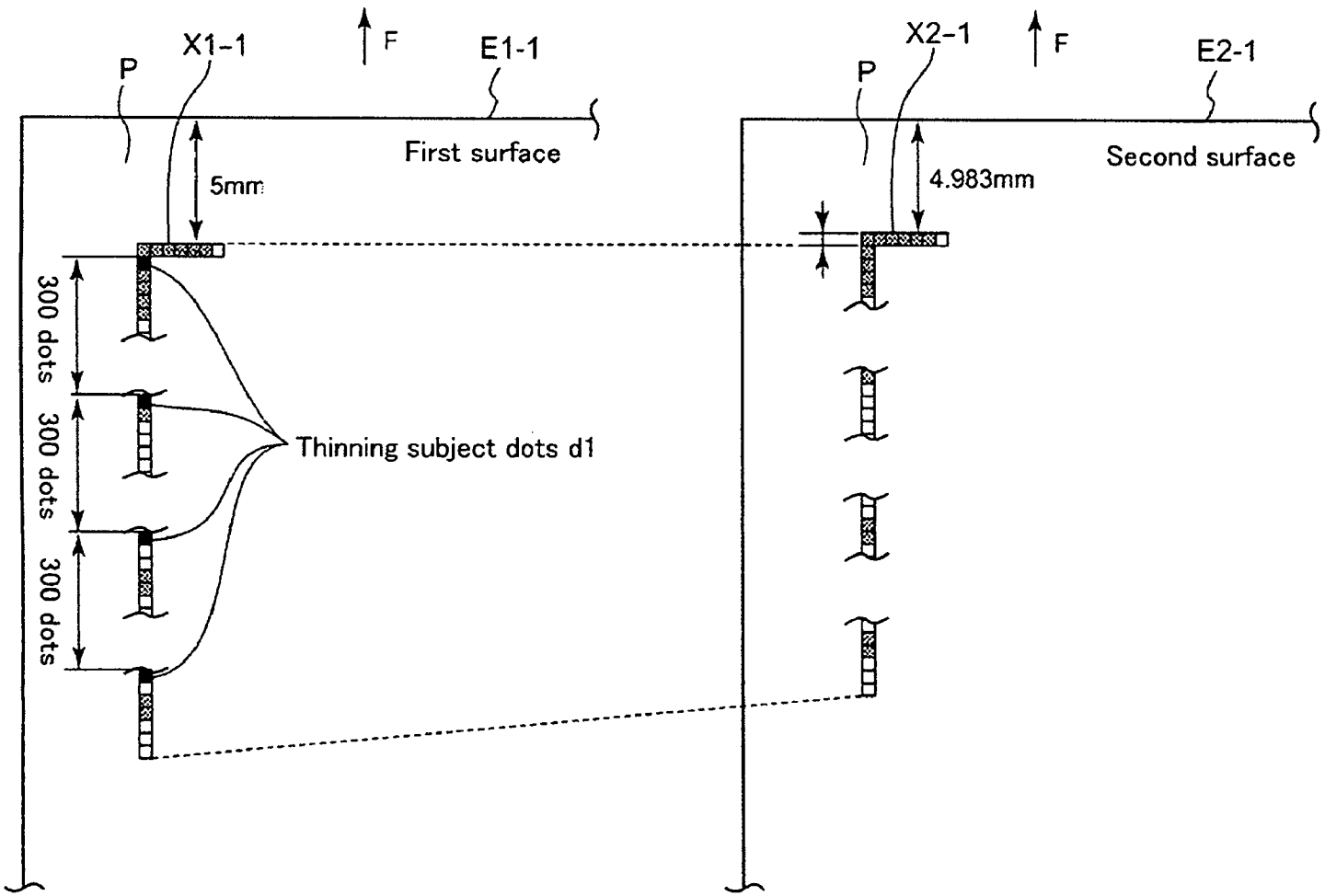
FIG. 5 an explanatory diagram illustrating a correction method for image data to be formed on the second surface of the recording medium.

FIG. 5 is an explanatory diagram illustrating the correction method for image data to be formed on the second surface of the recording medium P. If the second surface of the recording medium P uniformly shrinks compared to the first surface as a whole, as long as the size of an image to be formed on the second surface of the recording medium P is corrected to 99.66% of the original data in size, the image on the second surface shall become the same size of the image formed on the first surface of the recording medium P.

An important point at this time is to align the positions X1-1 and X2-1 for starting printing the image data in the distance from the front ends E1-1 and E2-1 of the recording medium P. Specifically, when the original image data is set to start printing from the position at distance 5 mm away from the front end E1-1 of the first surface of the recording medium P in the carrying direction F, for the second surface of the recording medium P, the shrinkage factor $\alpha$=99.66% is applied and printing is started from the position 4.983 mm away from the front end E2-1 of the second surface.

Alignment of the positions X1-1 and X2-1 to start printing the image data has a meaning as mentioned next. Namely, when the recording medium P with A4 size is printed by transverse feeding, the front end on the first surface becomes the back end of the second surface. The printing start position of the front end on the second surface can be aligned so as to uniform the margin at the front end on the first surface and the margin at the back end on the second surface, i.e., writing timing can be adjusted. Thus, because the margins on two sides at one side of the recording medium P with A4 size can be unified, the same binding margins can be secured on two sides for book binding or filing.

In addition, in the image forming device 1 of this embodiment, if a resolution of the image forming unit 108 is 1,200 dpi (dpi indicates the number of dots per inch; in this case, the number of dots is 1,200 per inch) both in the main scanning direction and sub scanning direction, the size of one dot is approximately 0.02 mm. Further, if the change in the length per inch (1-shrinkage factor $\alpha$) is converted into the number of dots of the image forming unit 108, this is equivalent to the reduction in length for four dots (one dot per 300 dots) per inch (1,200 dots).

Therefore, aligning the position and size of the entire image between the first surface and the second surface of the recording medium P can be realized, as shown in FIG. 5, by setting the printing start position X2-1 on the second surface of the recording medium P at 4.983 mm from the front end of the recording medium, and by thinning out data d1 for one dot per 300 dots both in the main scanning direction and sub scanning direction.

Next, the size of the recording medium P is generally 'variable' per recording medium P, and a method to handle with this variation is explained. In other words, when the size of the recording medium P in the carrying direction is different from a specified value from the point before the image formation on the first surface, a method of aligning the printing start position is explained. Furthermore, in the recording medium inversion mechanism of the image forming device 1 used in this embodiment, the carrying direction on the occasion of inversion of the recording medium P becomes back to the front as similar to the above-mentioned case. In other words, because the back end side at the time of image formation on the first surface becomes the front end side at the time of image formation on the second surface, it is necessary that the print starting position at the time of image formation on the second surface is aligned with the printing end position of the back end on the first surface.

During the process to form an image on the first surface, when the measurement result of the length of the recording medium P is different from the expected size for image formation, for example, when the length of the recording medium P is supposed to be 297 mm because of A4 size, a case where the measurement result of the length of the recording medium is 298 mm is explained.

Figure 6:
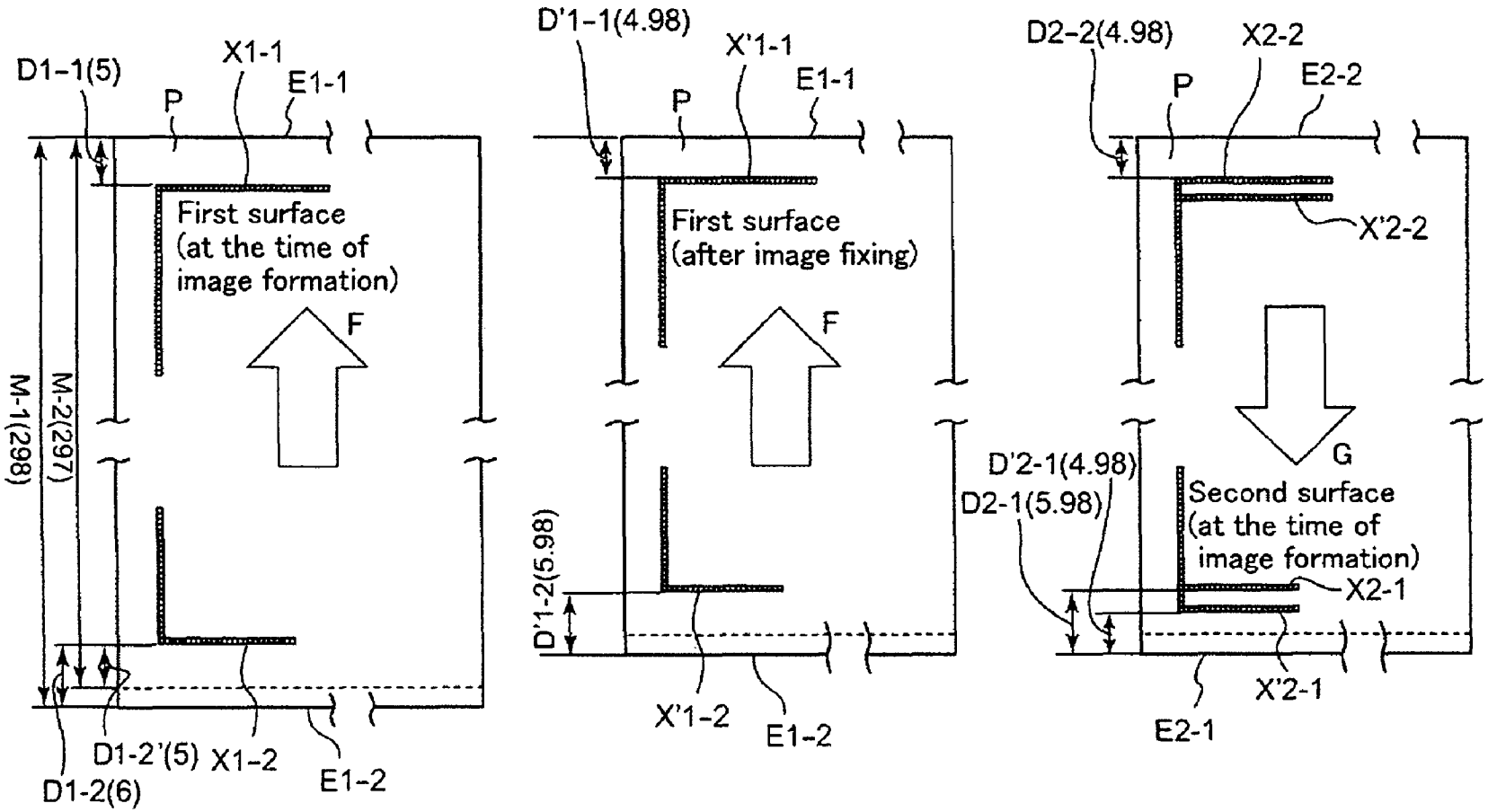
FIG. 6 is an explanatory diagram illustrating a control method in the case that size of a recording medium is different from that of image to be formed.

FIG. 6 is an explanatory diagram illustrating a control method in the case that the size of the recording medium P is different from the expected size for the image formation. In FIG. 6, the recording medium P shown at the left side indicates that at the time of image formation on the first surface (before passing the image fixing means 109), and the recording medium P shown in the middle indicates that after the image fixing on the first surface, and the recording medium P shown at the right side indicates that at the time of image formation on the second surface.

Further, M-1 in the diagram indicates the actual length of the recording medium P with A4 size (298 mm), and M-2 indicates the original length of the recording medium P with A4 size (297 mm). As similar to the mentioned above, E1-1 indicates the front end of the recording medium P when the first surface of the recording medium P is carried toward the carrying direction F, and E1-2 indicates the back end of the recording medium P in the similar condition. X1-1 indicates the printing start position on the first surface of the recording medium, and X1-2 indicates the printing end position on the first surface of the recording medium.

When the shrinkage factor $\alpha$ of the recording medium P after the image formation on the first surface is calculated at 99.66%, it is assumed that the image formed on the first surface starts from the position 5 mm away from the front end E1-1 of the recording medium P and ends at 287 mm of the distance from there. Therefore, a front end margin D1-1 of the front end E1-1 in the carrying direction F of the recording medium on the first surface of the recording medium P is 5 mm. Further, similarly, an actual back end margin of the back end E1-2 is D1-2 (6 mm). Furthermore, according to the original length M-2 of the recording medium P with A4 size is D1-2' (5 mm).

After the image is fixed onto the recording medium P, since shrinkage of the recording medium P results in the shift of the printing start position X1-1 on the first surface after the image formation to a printing start position X'1-1, the front end margin D1-1 is changed to a front end margin D'1-1 (4.98 mm). Further, for the back end E1-2 portion, since the printing end position X1-2 on the first surface of the recording medium P becomes X'1-2, the back end margin D1-2 (6 mm) is changed to a back end margin D'1-2 (5.98 mm).

In other words, although the margin at the back end E1-2 side on the first surface of the recording medium at the time of the image formation on the first surface is superficially the back end margin D1-2' (5 mm), in actuality, it is the back end margin D1-2 (6 mm). In the meantime, in the state where the recording medium P shrinks after the image is fixed, the margin at the back end E1-2 side on the first surface of the recording medium P is the back end margin D'1-2 (approximately 5.98 mm).

In the meantime, after passing through the image fixing means 109, when the two sides of the recording medium P are inverted and become back to front, the carrying direction F of the recording medium P becomes a carrying direction G, and the front end of the recording medium P becomes E2-1 and the back end becomes E2-2. On the second surface of the recording medium P, an image is formed by the image forming unit 108.

Furthermore, herein, in the image forming unit 108 on the second surface, when a position of the image data is not controlled, the front end printing start position is X'2-1, and the margin from the front end E2-1 becomes D'2-1 (4.98 mm). However, it is necessary that the printing start position X2-1 on the second surface is matched with the printing end position X'1-2 on the first surface. Therefore, the writing start timing is controlled so as to adjust the printing start position on the second surface to X2-1 by aligning with the printing end position X'1-2 at the back end E1-2 side on the first surface. Then, the front end margin D2-1 (5.98 mm) on the second surface is matched with the back end margin D'1-2 (5.98 mm) on the first surface.

In the meantime, it is necessary that the printing end position X2-2 on the second surface is matched with the printing start position X'1-1 on the first surface. Therefore, the size of the image data is controlled to adjust the printing end position on the second surface to X2-2 by aligning with the printing start position X'1-1 at the front end E1-1 side on the first surface. This size of the image data is controlled by thinning the image data using the method shown in FIG. 5. Consequently, the back end margin D2-2 (4.98 mm) on the second surface is matched with the front end margin D'1-1 (4.98 mm) on the first surface. Furthermore, X'2-2 in the diagram is the printing end position in the case of not controlling the size of the image data.

As described above, in the timing of the image formation on the second surface, the printing start position X2-1 becomes controllable based upon the printing end position X'1-2, which is the actual image data on the first surface of the recording medium P. Therefore, the front end margin D2-1 on the second surface can be aligned with the back end margin D'1-2 on the first surface.

Further, even in the image size on the second surface, it is possible to control the size to the printing end position X2-2 by aligning with the printing start position X'1-1 on the first surface. The image size from the printing start position X2-1 to the printing end position X2-2 can be controlled by thinning the image data in between. Therefore, the front end margin D2-2 on the second surface can be aligned to the back end margin D'1-1 on the first surface.

In addition, on the occasion of printing a plurality of recording mediums P, because the respective length of the recording mediums P is measured and the shrinkage factor α before and after passing through the fixing unit, even if there is variation in length and/or shrinkage in each recording medium P, the writing start position and image size can be determined by corresponding to the respective recording medium P.

Actual control is conducted using the following expression based upon the shrinkage factor α of the detected recording medium P:

$$\text{Printing start position on the second surface } X = \{(PL1 - PL) + X \text{ original}\} \times \text{shrinkage factor } \alpha$$

$$\text{Image data thinning interval } D = 1200/\{(25.4 - 25.4 \times \text{shrinkage factor } \alpha)/(25.4/1200)\}$$

Herein,

X: length from a front end of paper to a writing start position on the second surface at the time of image control;

PL1: actual length of the first surface of the recording medium P;

PL: expected length of the recording medium P; and

X original: length from the front end of paper to the writing start position on the second surface before the image control In this embodiment, the case of shrinking the actually-formed data with regard to the original data is used as an example, the method to control the size of image by thinning the image data is adopted; however, this is also applicable to the case of expanding image data, and in that case, the image size is controlled so as to interpolate the image data.

Further, regarding the control method for image data, any method is adoptable as long the method is to change data size for actual image formation compared to the original data of the image. For example, the control can be realized using a method for changing drive frequency of a motor, which is an exposure means of the image forming unit 108 or a driving source to carry the recording medium P.

Further, in this embodiment, the control of image data in the carrying direction of the recording medium P has been described; however, it is possible to similarly control the image data in a direction perpendicular to the carrying direction by using the shrinkage factor α of the recording medium P obtained by detecting the carrying direction.

Furthermore, in this embodiment, a reflective optical sensor was used as the medium length measuring unit 105; however, the detecting means is not limited to this sensor. Any means that can detect the ends of the recording medium P, such as a mechanical sensor or an ultrasonic sensor, is applicable. Further, in this embodiment, an LED head system using a light-emitting diode is used as the exposure means to the photoreceptor drum; however, a laser head of a semiconductor laser is also applicable.

Thus, according to the first embodiment, separately from the means to measure the length of the first surface of the recording medium P, after the image formation process on the first surface, the SMLM unit for measuring the length of the recording medium P is placed, for example, within the medium inversion path 151 after passing through the image fixing means 109, and this placement enables the measurement of the actual shrinkage factor α of the recording medium P to pass the image fixing means 109. This enables the control of image data at the time of double-sided printing from the first recording medium P. In addition, because the image data can be controlled to the recording medium P itself whose length is measured, it is possible to more certainly control the position of both sides at the time of double-sided printing based upon the shrinkage factor α, i.e., to control the writing start timing on the second surface and to control the image size, i.e., the size of image data from the writing start to the end.

In addition, it is possible to form an image with high positional accuracy without being affected by the dimension variation of the recording media themselves. Furthermore, the position to place the SMLM unit 217 for detecting the length of the recording medium P can be any position as long as it is in a position to calculate the shrinkage before the image formation process, and it shall not be always limited to within the medium inversion path 151.

Second Embodiment

Next, a second embodiment is explained. In the first embodiment, the medium length measuring unit 105 and the SMLM unit 217 are for measuring the length of the recording medium P in the carrying direction; however, in the second embodiment, a medium width measuring unit 305 and a second medium width measuring unit (SMWM unit) 317 are for measuring the width vertically to the carrying direction of the recording medium P.

Figure 7:
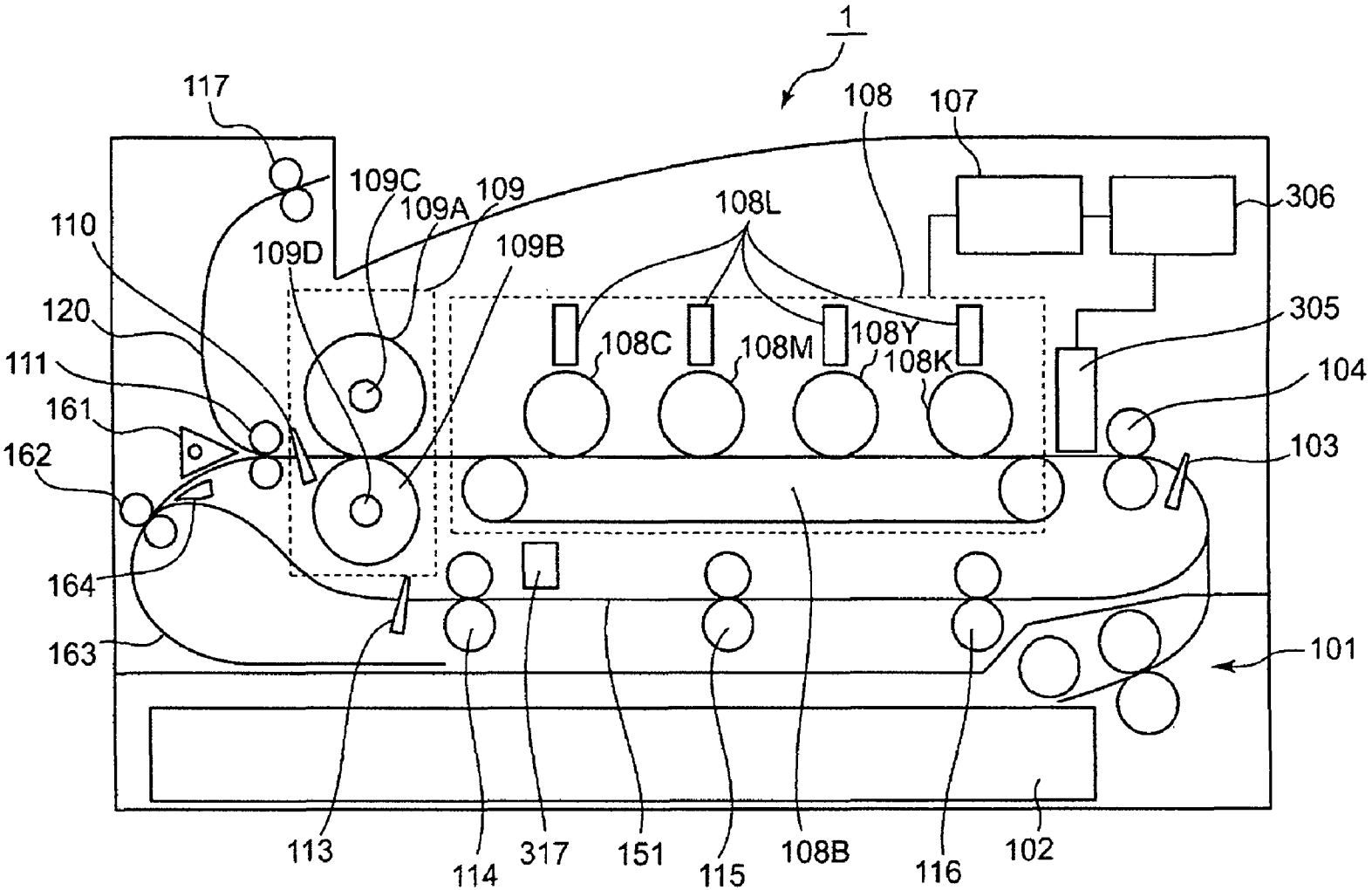
FIG. 7 is a schematic configuration diagram illustrating an image formatting device relating to a second embodiment.

FIG. 7 is a schematic block diagram of the image forming device 1 regarding the second embodiment. The paper feeding unit 101 is driven by a not-illustrated drive system, and feeds the recording medium P mounted on the paper feeding cassette 102 to the medium carrying path 141 toward the registration roller 104. The paper feeding detection means 103 detects that the recording medium P is fed to the registration roller 104.

The medium width measuring unit 305 is a line sensor arranged in a broader range than the carriable maximum recording medium width in the direction perpendicular to the recording medium carrying direction of the image forming device 1, and detects the width of passing recording medium P. The medium width measuring unit 305 is placed in the vicinity of the nip of the roller pair comprising the registration roller 104, and detects the width of the recording medium P passing under the registration roller 104.

Figure 8:
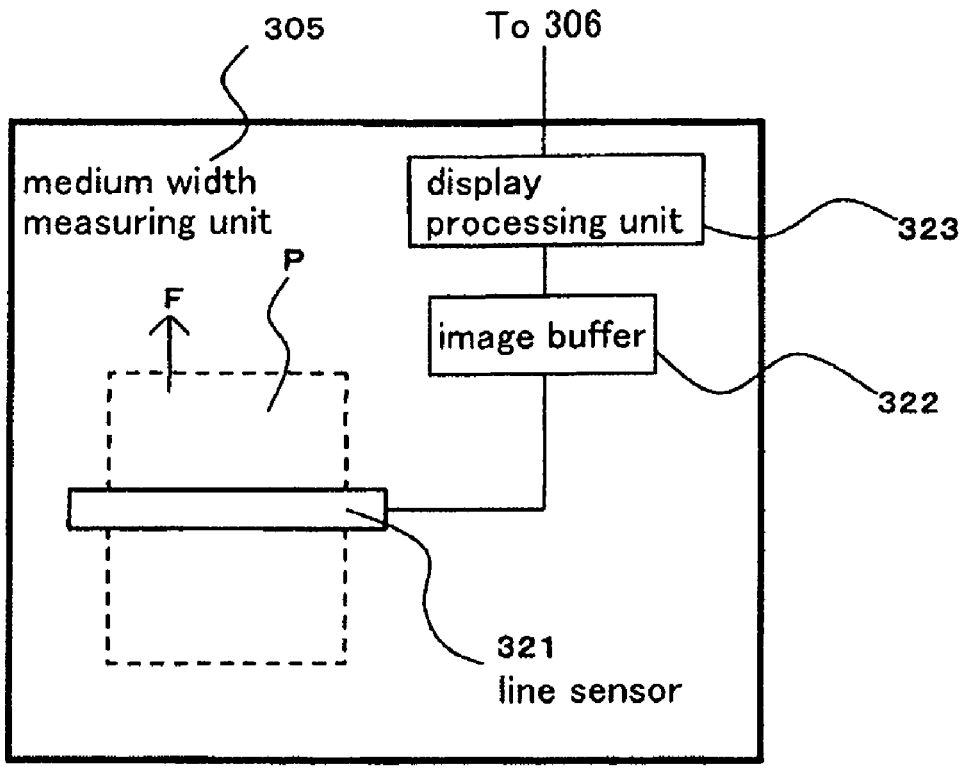
FIG. 8 is an explanatory diagram illustrating a configuration of a medium width measuring unit.

FIG. 8 is an explanatory diagram illustrating the configuration of the medium width measuring unit 305. The medium width measuring unit 305 is composed of a CCD sensor 321 arranged along the recording medium P, an image buffer 322 where an output from the CCD sensor 321 is temporarily accumulated, and a display processing unit 323 to convert the output from the image buffer 322 into a signal sequence and to output the signal sequence to a recording medium width calculation comparing unit (RMWCC unit) 306, orthogonally to the carrying direction of the recording medium P. In addition, the RMWCC unit 306 calculates the width of the recording medium P from the signal sequence received from the display processing unit 323 of the medium width measuring unit 305. In addition, the RMWCC unit 306 is connected to the image data control unit 107.

The image forming unit 108 is composed of the photoreceptor drums 108K, 108Y, 108M and 108C for forming an image; the LED head 108L arranged so as to face the photoreceptor drums 108K, 108Y, 108M and 108C as the exposure means to expose photoreceptor drums 108K, 108Y, 108M and 108C using a light-emitting diode as a light source; and the transferring belt unit 108B. The image forming unit 108 is controlled by the image data control unit 107, and forms an image on the recording medium P by the predetermined image formation process. The image forming unit 108 forms an image on one side of the recording medium P by synchronizing with the registration roller 104, and then, carries the recording medium P to the downstream image fixing means 109.

The image fixing means 109 is composed of a roller pair 109A and 109B pressured by predetermined contact pressure, and the roller pair incorporates heaters 109C and 109D for heating, respectively. The carriage detecting unit 110 detects a passage of the recording medium P where an image has been fixed by the image fixing means 109. The carrier roller pair 111 is placed ahead of the carriage detecting unit 110, and the separator 161 to separate the carrying direction of the recording medium P to a medium ejection path 120 and a medium inversion path 151 is arranged downstream. The separator 161 is switched and driven to one of the two directions at the time of ejection/inversion of the recording medium due to the control of a not-illustrated control unit.

The medium ejection path 120 is a path to eject the recording medium P where an image has been fixed by an ejection roller pair 117. In the meantime, the medium inversion path 151, in the case of double-sided printing, is a path to invert the recording medium P from a first surface to a second surface by the medium inversion roller pair 162 and the evacuation path 163, and in addition, to re-guide the recording medium P to the image forming unit 108 by the paper re-feeding carrier roller pairs 114, 115 and 116.

The medium inversion roller pair 162 is positively- and negatively-rotatable recording medium inversion means driven by the control of not-illustrated control unit. The medium inversion roller pair 162 temporarily carries the recording medium P to be carried from the separator 161 to the evacuation path 163. The inversion guide 164 is placed between the separator 161 and the medium inversion roller pair 162. After the medium inversion roller pair 162 guides the recording medium P to the evaluation path 163 for evacuation and the back end of the recording medium passes the inversion guide 164, the medium inversion roller pair 162 is inversely rotated due to the control of the control unit. Then, the back end of the recording medium P becomes a front end and the recording medium P doubles back at the inversion guide 164, and the recording medium P is carried to the medium inversion path 151. Thus, in the recording medium P, the carrying direction is inverted back to front; concurrently, the two sides are inverted.

The carrier detecting means 113 placed on the medium inversion path 151 detects the recording medium P carried on the medium inversion path 151 in order to re-carry the recording medium P whose two sides are inverted to the image forming unit 108. In addition, the paper re-feeding carrier roller pairs 114, 115 and 116 are driven and controlled by not-illustrated drive system and control unit, and carry the recording medium P to the registration roller 104 for re-feeding.

The SMWM unit 317 is arranged in the vicinity of the nip part of the paper re-feeding carrier roller pair 114 on the medium inversion path 141 in order to enhance the detection accuracy of the recording medium P, and detects the width of the carried recording medium P as similar to the medium width measuring unit 305. The SMWM unit 317 is a line sensor arranged in a broader range than the carriable maximum recording medium width in the direction perpendicular to the recording medium carrying direction of the image forming device 1, and detects the width of passing recording medium P.

Since the SMWM unit 317 has a similar configuration as that of the medium width measuring unit 305 shown in FIG. 8, the SMWM unit 317 is explained by replacing the medium width measuring unit 305 with the SMWM unit 317. The SMWM unit 317 is composed of the CCD sensor 321 arranged perpendicular to the carrying direction of the recording medium P and along the recording medium P, the image buffer 322 in which an output from the CCD sensor 321 is temporarily accumulated, and the display processing unit 323 that converts the output from the image buffer 322 into a signal sequence and that outputs the signal sequence to the RMWCC unit 306. In addition, the RMWCC unit 306 calculates the width of the recording medium P from the signal sequence received from the display processing unit 323 of the SMWM unit 317. In addition, the RMWCC unit 306 is connected to the image data control unit 107.

After carrying on the medium inversion path 151, in the recording medium re-fed to the registration roller 104, an image is formed on the second surface at the opposite side from that where the image was previously formed, with the same process as the image formation to the first surface. After the image fixing means 109 re-fixs the image, the separator 161 is switched to the ejection side. The carrier roller pair 111 and the ejection roller pair 117 eject the recording medium P to outside of the device via the medium ejection path 120.

Figure 9:
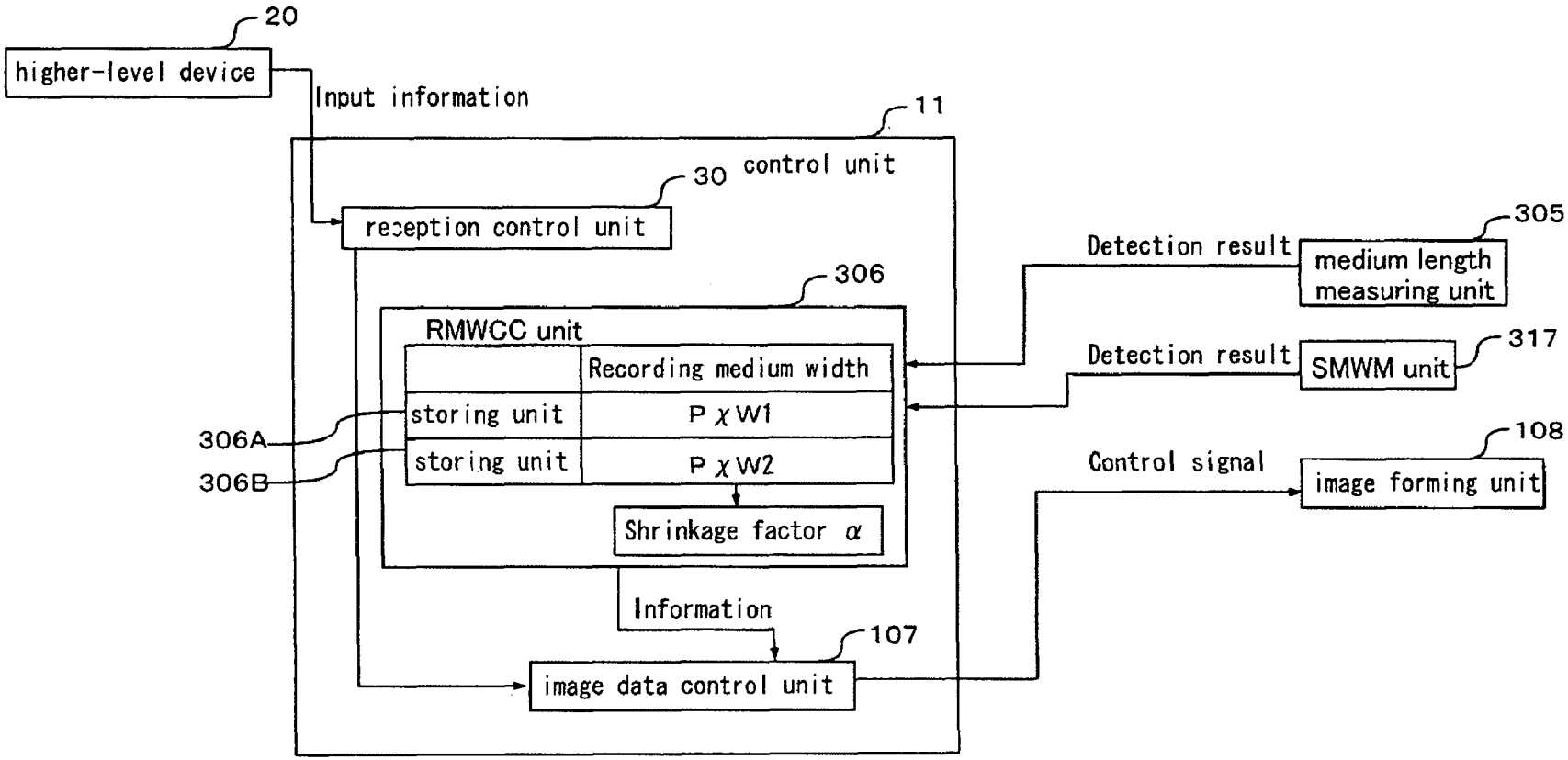
FIG. 9 is a block diagram illustrating a control unit of the image forming device relating to the second embodiment.

FIG. 9 is a block diagram illustrating the control unit 11 of the image forming device 1 regarding the second embodiment. The control unit 11 receives input information containing the image data from the higher-level device 20 of the image forming device 1 by the reception control unit 30. The input information received by the reception control unit 30 is sent to the image data control unit 107, and the image data control unit 107 controls the image forming unit 108 and an image is formed.

In the meantime, the information about the detection result of width of the first surface of the recording medium P detected by the medium width measuring unit 305 is sent to the RMWCC unit 306. In addition, information about the detection result of the width of the second surface of the recording medium P detected by the SMWM unit 317 is also sent to the RMWCC unit 306. The RMWCC unit 306 has storing units 306A and 306B at least for two recording mediums, and the detection results from the medium width measuring unit 305 and the SMWM unit 317 are stored, respectively.

In other words, the information about the width of the first surface of the recording medium P sent by the medium width measuring unit 305 is calculated as the width P×W1 of the recording medium P, and stored in the storing unit 306A. The information about the width of the second surface of the recording medium sent by the SMWM unit 317 is calculated as the width P×W2 of the recording medium P, and stored in the storing unit 306B.

In addition, the RMWCC unit 306 can compare the information P×W1 and P×W2 stored in the storing units 306A and 306B. For the comparison, the shrinkage factor $\alpha$=P×W2/P×W1 is calculated, and the result is sent to the image data control unit 107.

The image data control unit 107 controls so as to form an image without any special processing of the image data from the higher-level device 20 at the time of the first screen image formation upon the normal image formation or double-sided printing. Further, when the RMWCC unit 306 provides the information about the shrinkage factor $\alpha$, which is the width comparison result of the recording medium P, the image data control unit 107 controls so as to change the image size based upon the comparison result. In other words, the image data control unit 107 controls the size of an image to be formed on the second surface of the recording medium P based upon the information about the shrinkage factor α, and the image forming unit 108 forms an image.

Next, the performance of the image forming device 1 regarding the first embodiment is explained. In FIG. 7, the recording medium P1 to be carried first out of the recording media P mounted on the paper feeding cassette 102 is fed toward the image forming unit 108 from the paper feeding unit 101.

When the paper feeding detecting means 103 arranged at the downstream side of the paper feeding unit 101 detects paper feeding, the registration roller 104 carries the recording medium P1 to the image forming unit 108. The image forming unit 108 synthesizes with the registration roller 104, and forms an image based upon the image data controlled by the image data control unit 107 with the predetermined image formation process.

At this time, the medium width measuring unit 305 detects the width of the recording medium P1 to be carried toward the image forming unit 108 from the registration roller 104. Based upon the detection result, the RMWCC unit 306 calculates the width of the recording medium P1, and stores the information about the recording medium width P1W1 on the first surface in the storing unit 106A.

An image is transferred and formed on one surface side of the recording medium P1 carried to the image forming unit 108, and the recording medium P1 is carried to the image fixing means 109. The image fixing means 109 fixes the image onto the recording medium P1 due to heat and pressure by the roller pairs 109A and 109B heated by the heaters 109C and 109D, and the image formation to the first surface is completed.

In the double-sided printing to form an image on the second surface of the recording medium P1 to be carried first, a passage of the recording medium P1 where the image has been fixed by the image fixing means 109 is detected by the carriage detecting unit 110, and the recording medium P1 is guided to the medium inversion roller pair 162 by the separator 161. The medium inversion roller pair 162 temporarily carries the recording medium P carried from the separator 161 to the evacuation path 163. After the back end of the recording medium P has passed the inversion guide 164, the medium inversion roller pair 162 is reversely rotated by the control of the control unit. The back end of the recording medium P becomes a front end and doubles back at the inversion guide 164, and the recording medium P is carried to the medium inversion path 151. Thus, in the recording medium P, the carrying direction is inverted back to front; concurrently, the two sides are inverted. Then, the paper refeeding roller pairs 114, 115 and 116 are driven and controlled by the not-illustrated drive system and control unit, and the recording medium P is re-fed and carried to the registration roller 104.

At this time, the SMWM unit 317 detects the width of the recording medium P1 to be carried on the medium inversion path 151 toward the image forming unit 108. Based upon the detection result, the RMWCC unit 306 detects the width of the recording medium P1, and stores the information about the recording medium width P1W2 of the second surface in the storing unit 306B.

The image forming unit 108 forms an image on the second surface with the same process as that at the time of printing on the first surface, and the image fixing means 109 fixes the image onto the second surface of the recording medium P1. Then, the passage of the recording medium P is notified by the carriage detecting unit 110, and the recording medium P is ejected by the carrier roller pair 111 and the ejecting roller pair 117, and the image formation to two sides is completed.

Figure 10:
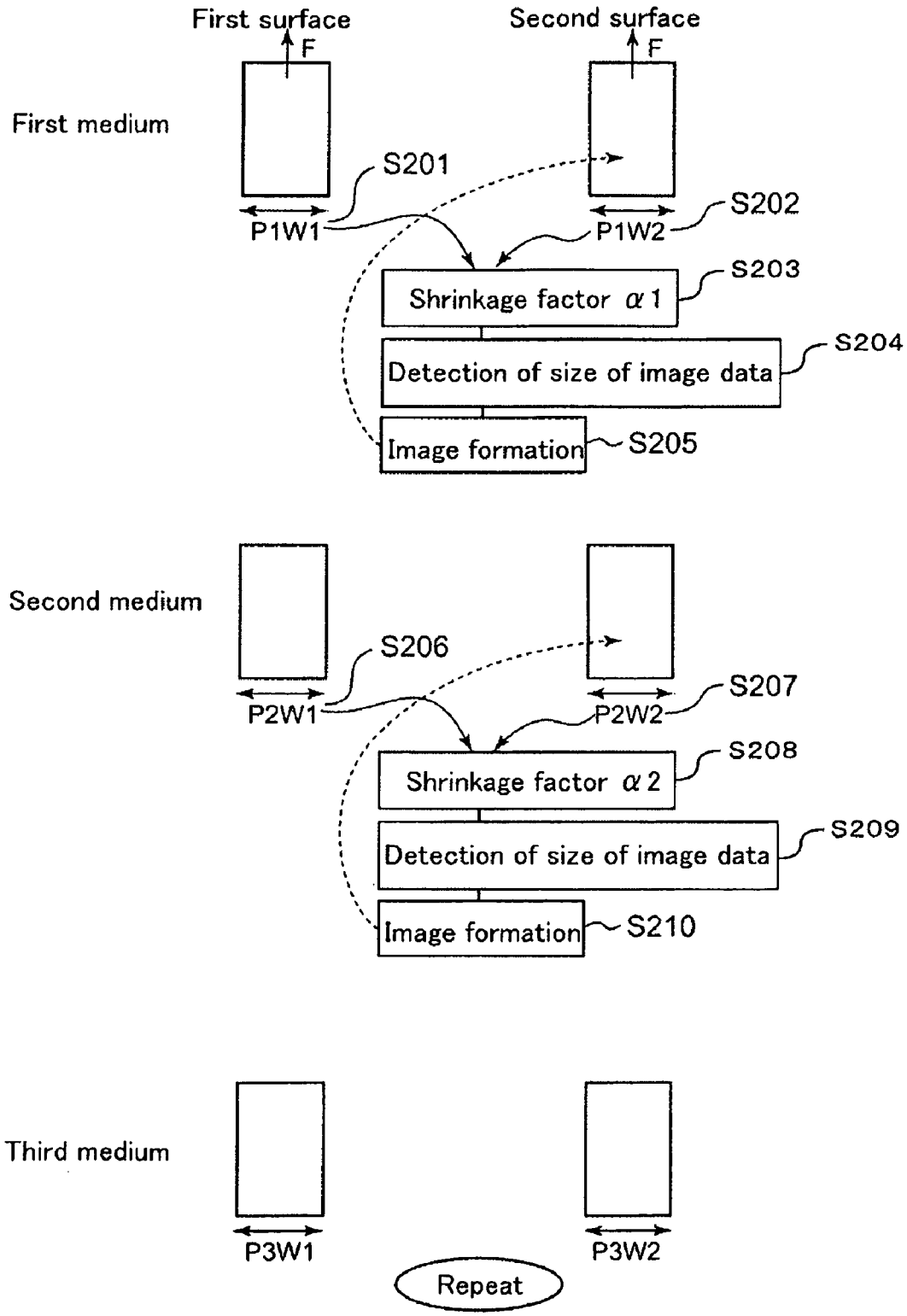
FIG. 10 is an explanatory diagram illustrating performance of the second embodiment.

FIG. 10 is an explanatory diagram illustrating performance in the second embodiment. In printing of the first recording medium P, the medium width measuring unit 305 detects the width P1W1 of the first surface vertically to the carrying direction F (S201). Then, the recording medium P is carried to the image forming unit 108, and the first surface is printed and the image is fixed by the image fixing means 109. On this occasion, the recording medium P shrinks as described above. The recording medium P is sent to the medium inversion path 151, and the SMWM unit 317 detects the width P1W2 of the second surface (S202).

As described above, when the recording medium widths P1W1 and P1W2 are stored in the storing units 306A and 306B of the RMWCC unit 306, respectively, the RMWCC unit 306 calculates the shrinkage factor α1 (S203). The RMWCC unit 306 sends the calculated shrinkage factor α1 to the image data control unit 107. The image data control unit 107 corrects the image data sent from the higher-level device 20 based upon the shrinkage factor α1, and determines the size of the image data to be printed onto the second surface (S204). When the image data control unit 107 sends the image data to the image forming unit 108, the image forming unit 108 forms an image on the second surface of the recording medium P based on the image data (S205).

Similarly, in printing of the second recording medium P, the medium width measuring unit 305 detects the width P2W1 on the first surface (S206). Then, the recording medium P is carried to the image forming unit 108, and the first surface is printed and the image is fixed by the image fixing means 109. The recording medium P is sent to the medium inversion path 151, and the SMWM unit 217 detects the width P2W2 on the second surface of the second medium (S207).

When the recording medium widths P2W1 and P2W2 are stored in the storing units 306A and 306B of the RMWCC unit 306, respectively, the RMWCC unit 306 calculates the shrinkage factor α2 (S208). The RMWCC unit 306 sends the calculated shrinkage factor α2 to the image data control unit 107. The image data control unit 107 corrects the image data sent from the higher-level device 20 based upon the shrinkage factor α2, and determines the size of image data to be printed onto the second surface (S209). When the image data control unit 107 sends the image data to the image forming unit 108, the image forming unit 108 forms an image on the second surface of the recording medium P (S210). Thereafter, this process is repeated.

With this process, the correction of image data in the printing of the second surface is available from even the first recording medium P1 that is initially carried to a subsequent medium. Further, the measurement of the recording medium width P2W2 at the time of printing the second surface of the (second) recording medium P2 and calculation of the shrinkage factor α2 according to the comparison with the width P2W1 at the time of printing the first surface enable the maintenance of the information about the shrinkage factor α of the recording medium P to always be current.

Thus, since the effect on carriage variation of the recording medium P is excluded by calculating the shrinkage factor α of the recording medium P based upon the measurement result of the width of the recording medium P, it is possible to lessen a measurement error in the shrinkage factor α, and to more accurately adjust an image.

What is claimed is:

1. An image forming device, comprising:

a medium carrying path configured with to carry a recording medium, an image forming unit configured with at least a plurality of photoreceptor bodies, the photoreceptor bodies being arranged along the medium carrying path, the image forming unit configured to form an image, based on image data, onto the recording medium carried on the medium carrying path;

a fixing unit configured to fix the image formed by the image forming unit onto the recording medium;

a medium inversion path configured to invert the recording medium where the image has been fixed onto the first surface by the fixing unit to the second surface, and to carry the recording medium to the image forming unit;

a first measuring unit placed within the medium carrying path and configured to measure a size of the recording medium when the image is formed on the first surface by the image forming unit;

a second measuring unit configured to measure the size of the recording medium prior to another image being formed on the second surface of the recording medium by the image forming unit; and a control unit configured to change the size of printing range based upon the image data that is used to form the image on the second surface of the recording medium in accordance with a ratio of the size of the recording medium measured by the first measuring unit to the size of the recording medium measured by the second measuring unit, wherein the second measuring unit is arranged at a measurement position in the medium inversion path where the second measuring unit begins to measure the size of the recording medium, one of the photoreceptor bodies is arranged at a transfer position where the image on the photoreceptor body at the transfer position is transferred to the recording medium, a first distance from the measurement position to the transfer position is greater than a length of the recording medium, and the photoreceptor body at the transfer position is arranged upstream relative to all other photoreceptor bodies.

2. The image forming device according to claim 1, wherein the respective sizes of the recording medium measured by the first and second measuring units comprise respective lengths of the recording medium.

3. The image forming device according to claim 1, wherein the respective sizes of the recording medium measured by the first and second measuring units comprise respective widths of the recording medium.

4. The image forming device according to claim 1, wherein the control unit is configured to execute the change of the size of the printing range based upon a change of a printing start position for forming the image on the second surface of the recording medium.

5. The image forming device according to claim 1, wherein the control unit is configured to execute the change of the size of the printing range based on changes of a printing start position and a printing end position for forming the image on the second surface of the recording medium.

6. The image forming device according to claim 1, wherein the control unit is configured to execute the change of the size of the printing range corresponding to matching a margin for image formation on the first surface of the recording medium and another margin for image formation on the second surface of the recording medium.

7. The image forming device according to claim 1, further comprising:

a plurality of exposure devices that are respectively arranged to face the photoreceptor bodies, wherein one of the plurality of exposure devices is arranged at an exposure position where the exposure device exposes the photoreceptor body arranged at the transfer position, and the first measuring unit is arranged at a front end position that is located at an upstream side along the medium carrying path and that is spaced apart from the transfer position by a distance greater than or equal a circumferential distance of the photoreceptor body from the exposure position to the transfer position.

8. The image forming device according to claim 7, wherein the front end position is defined as a position where a front end of the recording medium exists when the exposure device begins to expose the photoreceptor body for printing without a margin.

9. The image forming device according to claim 7, wherein a second distance from the measurement position to the front end position is greater than the length of the recording medium.

10. The image forming device according to claim 1, further comprising a plurality of exposure devices that are respectively arranged to expose the photosensitive bodies.

11. The image forming device according to claim 10, wherein the image is transferred on the second surface of the recording medium from the photoreceptor body at the transfer position, and the transfer position is defined as a position located downstream from the front end position by a distance greater than or equal to a circumferential distance of the photoreceptor body at the transfer position, the circumferential distance being defined as a length from an exposure position where an image exposure begins on the photoreceptor body to the transfer position.

12. The image forming device according to claim 11, wherein the photoreceptor bodies are detachable with the image forming device.

13. An image forming method, comprising:

measuring a size of a recording medium by a first measuring unit when an image is formed on a first surface of the recording medium at a front end position where the first measuring unit begins to measure the size of the recording medium;

measuring a size of the recording medium by a second measuring unit prior to another image being formed on a second surface of the recording medium at a measurement position, wherein a second distance from the measurement position to the front end position is greater than a length of the recording medium;

controlling image data by a control unit to change a size of a printing range based upon the image to be formed on the second surface of the recording medium in accordance with a ratio of the size of the recording medium measured by the first measuring unit to the size of the recording medium measured by the second measuring unit; and transferring the image on the second surface of the recording medium from a photoreceptor body at a transfer position, wherein the transfer position is defined as a position located downstream from the front end position by a distance greater than or equal to a circumferential distance of the photoreceptor body, the circumferential distance being defined as a length from an exposure position where an image exposure begins on the photoreceptor body to the transfer position.

14. The image forming method according to claim 13, wherein the respective sizes of the recording medium measured by the first and second measuring units comprise lengths of the recording medium.

15. The image forming method according to claim 13, wherein the respective sizes of the recording medium measured by the first and second measuring units comprise widths of the recording medium.

16. The image forming method according to claim 13, wherein the control unit is configured to execute the change of the size of the printing range based upon a change of a printing start position.

17. The image forming method according to claim 13, wherein the control unit is configured to execute the change of the size of the printing range based on a change of a printing start position and a printing end position.

18. The image forming method according to claim 13, wherein the control unit is configured to execute the change of the size of the printing range corresponding to matching a margin for forming an image on the first surface with a margin for forming an image on the second surface.

19. An image forming device, comprising:

an image forming unit configured to form images on a recording medium based on image data;

a first measuring unit configured to measure a size of the recording medium when the image forming unit forms a first image on a first surface of the recording medium;

a second measuring unit configured to measure the size of the recording medium prior to the image forming unit forming a second image on a second surface of the recording medium; and a control unit configured to change a printing range for the second surface in accordance with a ratio of the size of the recording medium measured by the first measuring unit to the size of the recording medium measured by the second measuring unit, wherein the control unit is configured to change the printing range for the second surface in accordance with a shrinkage factor α of the recording medium based on the following:

$$X=\{(PL1-PL)+X\text{ original}\}\times\alpha,\text{ wherein}$$

X is a length from a front end of the recording medium P to a writing start position on the second surface at a start of image control, PL1 is an actual length of the first surface of the recording medium P, PL is an expected length of the recording medium P, and X original is a length from the front end of the recording medium to the writing start position on the second surface before the start of image control.

20. The image forming device according to claim 19, further comprising a medium inversion path configured to invert the recording medium to the second surface after the image forming unit forms the first image on the first surface, and to return the recording medium to the image forming unit to form the second image on the second surface.

21. The image forming device according to claim 19, wherein the control unit is configured to control image size based on the following:

$$D=1200/\{(25.4-25.4\times\alpha)/(25.4/1200)\},\text{ where } D \text{ is an image data thinning interval.}$$

* * * * *